US006131784A

United States Patent [19]

Helgesson et al.

[11] Patent Number: 6,131,784

[45] Date of Patent: Oct. 17, 2000

[54] THREADING DEVICE

[75] Inventors: Leif Helgesson, Karlstad; Mikael Nyman, Forshaga, both of Sweden

[73] Assignee: Valmet-Karlstad AB, Karlstad, Sweden

[21] Appl. No.: 09/218,933

[22] Filed: Dec. 22, 1998

Related U.S. Application Data

[60] Provisional application No. 60/072,326, Jan. 23, 1998.

[30] Foreign Application Priority Data

Dec. 22, 1997 [SE] Sweden ..... 9704796

[51] Int. Cl.[7] ..... D21F 01/36

[52] U.S. Cl. ..... 226/91; 162/193

[58] Field of Search ..... 226/91, 92; 242/562.1, 242/562; 162/193, 194, 255

[56] References Cited

U.S. PATENT DOCUMENTS

| | | | |
|---|---|---|---|
| 3,105,649 | 10/1963 | Neupert | 226/92 X |
| 3,529,755 | 9/1970 | Spangenberg et al. | 226/92 X |
| 4,309,830 | 1/1982 | Vits | 226/92 X |
| 4,429,819 | 2/1984 | Palovaara | 226/91 X |
| 4,684,443 | 8/1987 | Kerttula et al. . | |
| 4,904,344 | 2/1990 | Peiffer | 226/91 X |
| 4,923,567 | 5/1990 | Liedes et al. . | |
| 5,816,465 | 10/1998 | Suzuki | 226/92 |
| 5,989,393 | 11/1999 | Kivimaa et al. | 162/360.2 |

*Primary Examiner*—Donald P. Walsh
*Assistant Examiner*—Collin A. Webb
*Attorney, Agent, or Firm*—Alston & Bird LLP

[57] ABSTRACT

A device for drawing a web through an open draw in a paper or board machine with the aid of a leader, said open draw extending between a first web-carrying element and a second web-carrying element, said device comprising a stand structure and a transfer member having the width of the leader. According to the invention the transfer member is arranged to be inserted at and above the first web-carrying element and set in various predetermined positions, the device having setting members for setting the position and direction of the transfer member in relation to the second web-carrying element; a travelling member to carry and move the transfer member; and actuator for operating the travelling member.

18 Claims, 7 Drawing Sheets

1
31
61
28
63
60
59
26
85
65
86
87
88
78
57
69
48
39
68
32
21
47
34
40
51
75
77
23
38
22
74
76
44
49
56
54
42
71
41
53
37
35
50
41
24
30
51
42
45
52
47
48
58
40
25
39

1
61
28
26
63
65
60
59
85
86
87
88
78
69
68
21
48
47
46
71
75
52
57
77
74
51
43
23
77
76
22
74
44
54
49
50
56
35
53
24
36
30
45
51
43
46
52
58
47
48

THREADING DEVICE

CROSS-REFERENCE TO RELATED APPLICATIONS

This application claims the benefit of U.S. Provisional Application Ser. No. 60/072,326 filed Jan. 23, 1998.

FIELD OF THE INVENTION

The present invention relates to papermaking machines and more particularly to devices for drawing a web through an open draw in a papermaking or board machine with the aid of a leader.

BACKGROUND OF THE INVENTION

In all paper production, whether cardboard, board or tissue, at least one fiber web is conveyed continuously through a machine from the moment when the fiber web is formed in a wire machine until the finished web is wound up to form a reel in a reel-up. The machine consists of a plurality of different and separate machine parts, sections, arranged in sequence one after the other, that gradually transform the fiber web to a finished reel of paper. The various sections are essentially, wire, press and drying sections and a final reel-up.

Board and cardboard differ from what is generally termed paper primarily in the greater demands for rigidity and thickness. Cardboard also generally consists of several layers couched together, each layer having a different stock content. The same term is frequently used for several different types of paper material and the terms used are therefore to be considered as somewhat flexible. However, the following approximate limits should be considered as prevailing generally. Between paper and cardboard the limit lies at a basis weight of about 100 g/m$^2$, whereas the limit between cardboard and board is sometimes stated to be about 600 g/m$^2$. The problems that arise when feeding along a new material web in a machine are substantially the same, regardless of the type of paper, i.e., paper, cardboard or board, or of the machine design such as a paper making or board machine that is used. The term "paper" will be used in the following unless a particular type of paper or machine type is expressly intended.

When a new web end is to be passed through the separate sections of the papermaking machine, which has to be carried out after a web rupture or a machine stop, this is done by means of threading. In order to facilitate threading, a narrow strip is separated from the rest of the web by a cutter, usually in the form of a water jet. This separation is performed, for instance, on the wire immediately before the web is transferred to the press section. The leading end of the paper web is thus shaped to form a leader with a width of suitably about 100–200 mm. This leader is either blown over to the press section with an air cushion inside the wire or, in a closed transfer, is gripped by a suction roll so that the web is lifted over to the press section.

The leader is then fed on through the papermaking machine and over all the open draws existing therein, either, entirely by hand or with a certain amount of assistance from various blowers for the purpose. The term "open draw" refers to the gap formed between a first machine part and a second machine part following the first in the machine direction, over which gap the web is forced to run freely without support from a supporting surface such as a wire or felt, for instance. The blowers, at least in theory, force the carried leader in a certain direction so that it passes over the open draw and further on into the next drive section.

The simplest blowers are ordinary compressed air nozzles which have openings or small holes drilled with a certain mutual pitch, placing and number in the longitudinal extension of the nozzle. Since the ability of these more or less stationary blowers to transfer the end of the web in a correct manner is to a great extent dependent on the vibratory movements, web flutter, which exist in the entering leader, these blowers are far from sufficient to reliably and precisely transfer the web during threading.

The open draws may be situated between the wire section and the press section, for instance, as is the case in slow-running machines where the web is lifted off the wire at the couch roll and thus is passed over to the felt; inside the press section between one or more of the presses arranged therein; and between the press section and the drying section. The risk of web rupture increases substantially at the open draws and therefore one tries to replace these with a web transfer which is closed as far as possible. This can be achieved, for instance, by using a pick-up roll wrapped by a felt when transferring the web from the wire, or with connected press nip in the press section.

A drawback with connected press nips is that the two sides of the paper web, the wire side and the upper side, will not be the same since, contrary to the wire side, the upper side does not run against a smooth roll surface but all the time runs against felted rolls. If a web is desired having both sides as alike as possible, the upper side of the fiber web must also be allowed to run against a smooth roll. For this reason a special type of press section is usually used in this case which includes a separate third or fourth smooth press nip. However, this means that an open draw is unavoidable, with the associated transfer problems.

Another problem is the open draw between the press section of the paper machine and its drying section. Attempts have been made, however, to minimize the gap across which the web must run freely by arranging some form of web stabilizer to partially bridge the gap. Such a web stabilizer is usually constructed so that the drying wire is drawn in a loop around a guide roll arranged as close as possible to the outlet from the central roll of the press section, or the last press roll in the direction of the machine. At least one blow box is arranged inside the drying wire loop and helps to guide the leader with the aid of a flow of compressed air operating in the direction of movement of the paper web so that a vacuum effect occurs, a Coriolis effect, on the lower side of the web stabilizer bringing the leader against the surface of the drying wire loop. Once the leader has been taken over by the web stabilizer it is conveyed further by the drying wire loop up to and into the first nip formed at the first drying cylinder. The open draw between press section and drying section is thus greatly reduced, thereby facilitating also the transfer of the paper web. However, an open draw, although somewhat narrower, will still remain between the drying wire loop and the press section and therefore still constitutes a serious risk of unsuccessful threading or, in the worst case, a web rupture.

The guide roll, and also the drying wire running around it and enclosing the blow box, have a blocking effect on the air flows necessary to feed the leader forwards, the flows already having a very limited sphere of influence close to the drying wire loop. The suction effect that these blow boxes give rise to can therefore only grip the leader if it can be brought close enough and since before passing through the drying section, the leader still contains so much water that it is weighted down by moisture and very much still adhered to the press felt, threading at this open draw must still be performed by hand in spite of the web stabilizer. This can usually be done with the aid of a portable compressed-air device that the operator inserts in the space between press section and drying section. This manual procedure constitutes an extremely time-consuming and therefore expensive problem in the paper industry, particularly since developments in other respects tend towards higher speeds and lower basis weights in the running paper webs.

Pivotable blow tables are disposed further on in the paper machine, where the fiber web is considerably drier and therefore much lighter and not so firmly adhered. These are folded up from beneath, i.e., against the lower side of the fiber web. Remaining open draws can thus be bridged so that the web is transferred carried by an air cushion from the blow table, without any greater risk of it adhering. However, these blow tables require considerable space to move and obviously cannot be installed if a wire or felt intersects the path of movement it requires, as is the case in the open draws described above inside the press section and at the connection of the press section to the drying section. Since, when folded up, the pivotable blow table thus cuts the moving fiber web, such a blow table is also arranged, with the aid of a knife means, to cut off the leader. This is possible with a drier and thus more easily cut web, but as with a moist web in a press section it is almost impossible to achieve without the use of the water jet mentioned above.

Furthermore, the physical space in the press section does not allow for installation of the same type of equipment as is used in the drying section; the equipment, which functions satisfactorily when a drying web is moving, would result in the leader becoming irretrievably adhered when used for the fiber web in the press section which is still very wet.

Once threading has been successfully performed in a press section, the above-mentioned cutter is moved across the web so that the width of the leader increases until the web is again moving at full width. While threading is being performed the rest of the web is permitted to run down into a device called reject disintegrator, intended for disintegration of pieces cut or rejected from the paper web.

The development of the threading process described has been necessary in order to cope with the ever increasing speeds. Manipulating the leader by hand always entails risks and these increase with the speed. It will be readily understood that manual threading furthermore is extremely inefficient and expensive. It should therefore be obvious that it would be of extremely great significance to the paper and board manufacturing industry if an automatic and adjustable threading device could be developed which can be used quickly and safely to bridge the open draws still existing between press section and drying section, as well as the one in a press section comprising one or more separate press nips.

One object of the present invention is to at least for the most part remove the problems mentioned above and provide an improved device for leading and adjusting the position and direction of a leader when threading in a paper or board machine.

Another object of the invention is to provide a device that will enable fully automatic threading to be performed through all parts of a paper or board machine, all open draws thus being bridged in a safe and reliable manner, including the open draw between the press section and the drying section.

Yet another object of the invention is to provide a device for threading in a paper or board machine, in which the leader is transferred in a safe and reliable manner to a web stabilizer advanced from the drying section towards the press section.

SUMMARY OF THE INVENTION

The device according to the invention is characterized in that the transfer member is arranged to be inserted at and above the first web-carrying element and arranged to be set in various predetermined positions beside and in the open draw. The device comprises a plurality of setting members for setting the position and direction of the transfer member in relation to the second web-carrying element, a travelling member to carry and move the transfer member, and actuators for operating the travelling member. The transfer member comprises a plurality of air supply tubes arranged one after the other and extending transversely to the leader which is being led by the transfer member in the machine direction, a connecting element to which each tube is rigidly mounted at one end, and an air distributing pipe to which each air supply tube is rigidly mounted at its other end in open communication therebetween such that each air supply tube is provided with opening means to supply a flow of air in the drawing direction of the leader. The air flow forms a sliding surface at the lower side of the transfer member such that the air flow creates a negative pressure between the leader and the next air supply tube, which negative pressure carries the web, and that the air flow exerts a tensile force on the leader along the sliding surface.

Thanks to the present invention the remaining open draws are bridged even in a modern paper machine, thus greatly reducing the risk of web rupture and increasing the ductibility of the paper in the direction of the machine so that it is tougher and more resistant for the subsequent conversion in a packing machine or printing press.

BRIEF DESCRIPTION OF THE DRAWINGS

The invention is explained in more detail in the following, with reference to the drawings.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
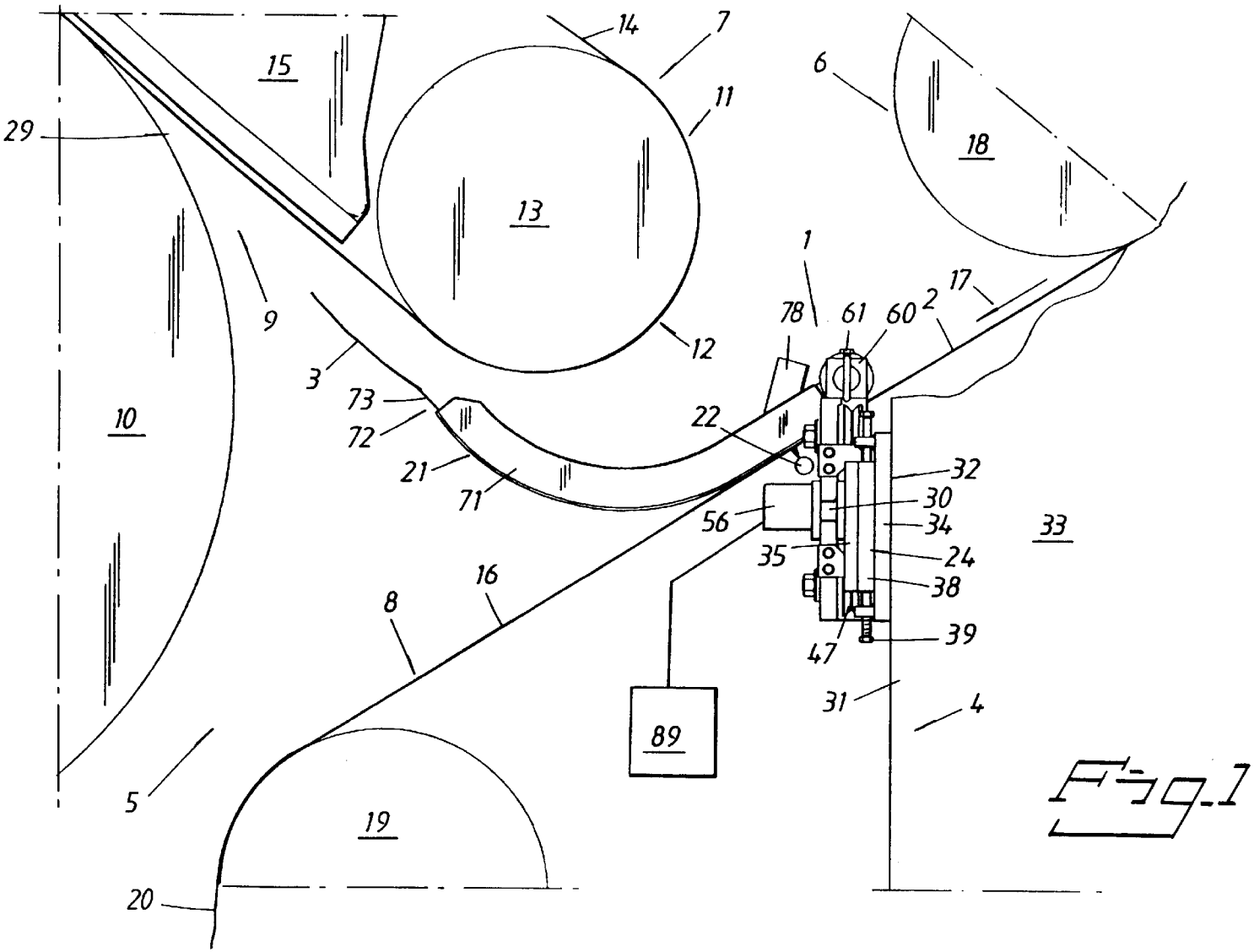
FIG. 1 is a schematic side view of parts of a threading device according to the present invention, seen from the operator side, the threading device being shown in a position between a press section and a drying section, comprising a movable web stabilizer.

FIG. 1 shows schematically from the side parts of a device 1 for threading a fiber web 2, e.g., a paper or board web, which fiber web 2 is conveyed in the form of a leader 3 through a paper or board machine 4 and over all the open draws 5 therein. The machine 4 comprises a press section 6 and a drying section 7. In the embodiment shown the threading device 1 is arranged at one of the above-mentioned open draws 5, namely the one formed between an outlet device 8 belonging to the press section 6, situated upstream, and an inlet nip 9 to the drying section 7, situated downstream of the draw 5. The inlet nip 9 is formed between a first drying cylinder 10 and an elongate web stabilizer 11 protruding therefrom, which is movable towards the outlet device 8 of the press section 6.

The web stabilizer 11 comprises a rotatable guide roll arranged at its free, outer end 12, and a web-carrying element 14 in the form of a drying wire loop running around the guide roll 13. A blow box 15 is arranged inside the drying wire loop 14. If deemed advantageous the blow box 15 may include both blow and suction means with associated openings distributed across the outer sides of the blow box 15 in a suitable manner for the necessary air flows. When threading is to be performed the web stabilizer 11 is altered, with the aid of actuators not shown, from a first, upper operating position during which an uncut, full-width web 2 is transferred the shortest distance between the outlet device 8 of the press section 6 and the inlet nip 9 of the drying section 7, to a second, lower threading position. In this lower threading position the free outer end 12 of the web stabilizer 11 is arranged as close as is functionally possible to the outlet device 8 of the press section 6. This is to minimize the open draw 5, over which the fiber web 2 must run freely without any support from the drying wire 14, for instance.

The outlet device 8 also consists of a web-carrying element 16 in the form of a felt loop, protruding from a roll 18, usually a press roll or a central roll, in the direction of the machine 17, the roll being arranged last in the press section 6, i.e., the roll 18 situated closest to the open draw 5. As in the web stabilizer 11 mentioned above, the felt loop 16 runs around a guide roll 19 arranged outermost in the loop 16, but with the essential difference that the felt loop 16 in the shown embodiment is a loop 16 arranged below the arriving fiber web 2, above which the fiber web 2 is conveyed, whereas the drying wire loop 14 arranged downstream of the open draw 5 is a loop 14 arranged above the fiber web 2 which thus receives the fiber web 2 at its lower side through the suction effect created by the blow box 15 arranged inside the drying wire loop 14 so that, after receipt, the fiber web 2 is conveyed on into the inlet nip 9 of the drying section 7.

When threading, the still wet and therefore very adhesive fiber web 2 is conveyed to the open draw 5 divided into at least two parts consisting of the leader 3 and a web remnant 20. The web remnant 20 runs over the guide roll 19 of the outlet device 8 and on down into a reject disintegrator (not shown) arranged below the open draw 5 while, by compressed air being blown through the felt loop 16 towards the lower side of the leader, the leader 3 is first loosened from its adhesion to the outlet device 8 and then lifted in the direction of a transfer member 21, described in more detail below, pertaining to the threading device 1. To obtain the compressed-air jets necessary to loosen and lift the leader 3 a blower 22 (see FIG. 3) in the form of a blow pipe, for instance, is arranged inside the outlet device 8, which blow pipe 22 is provided with a plurality of small openings 23 with suitable distribution to produce the compressed-air jets.

Figure 2:
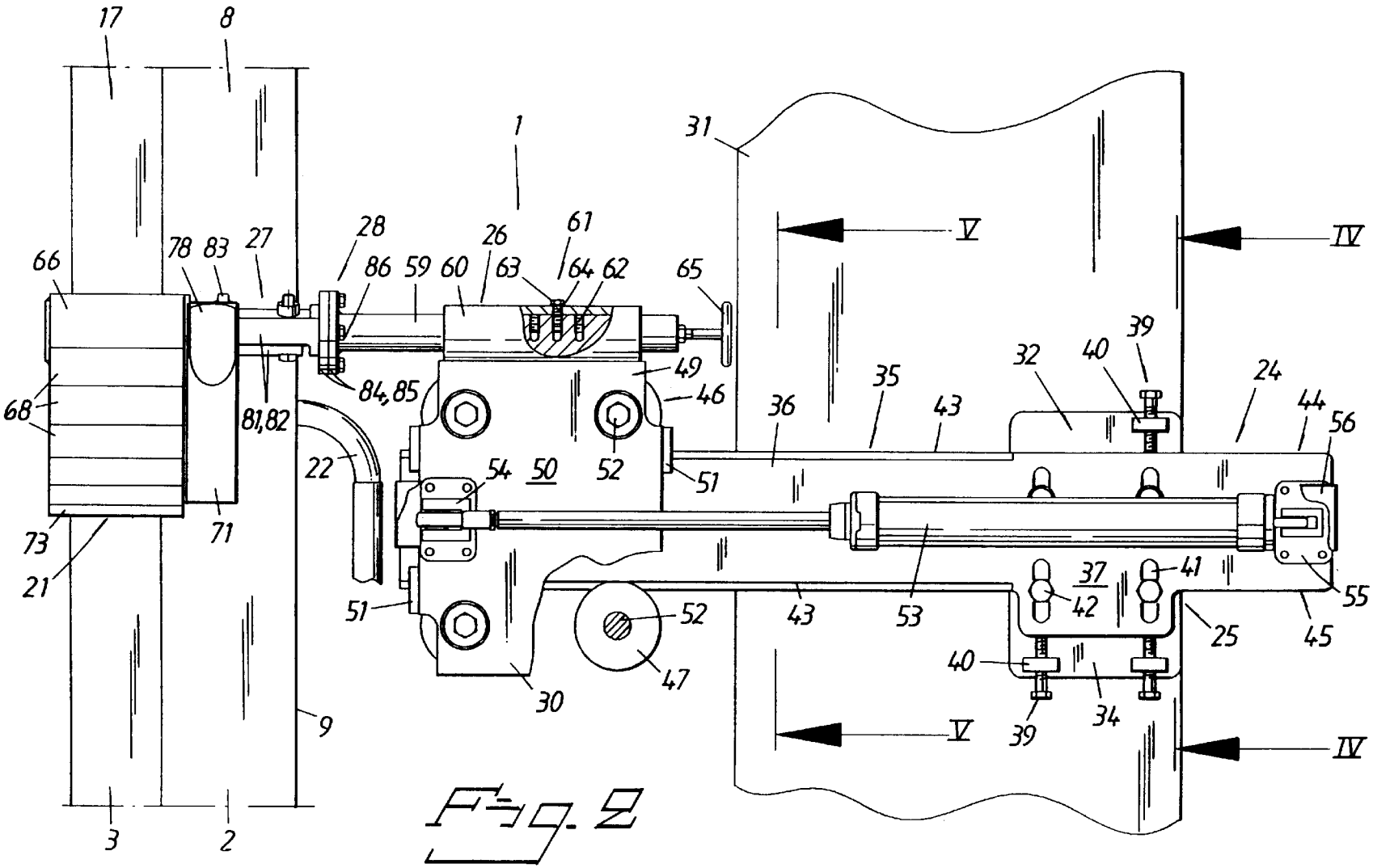
FIG. 2 is a schematic front view of parts of the threading device according to FIG. 1 seen upstream, with certain parts cut away and showing a transfer member in an outer threading position above and close to a leader fed forward on a felt.
Figure 3:
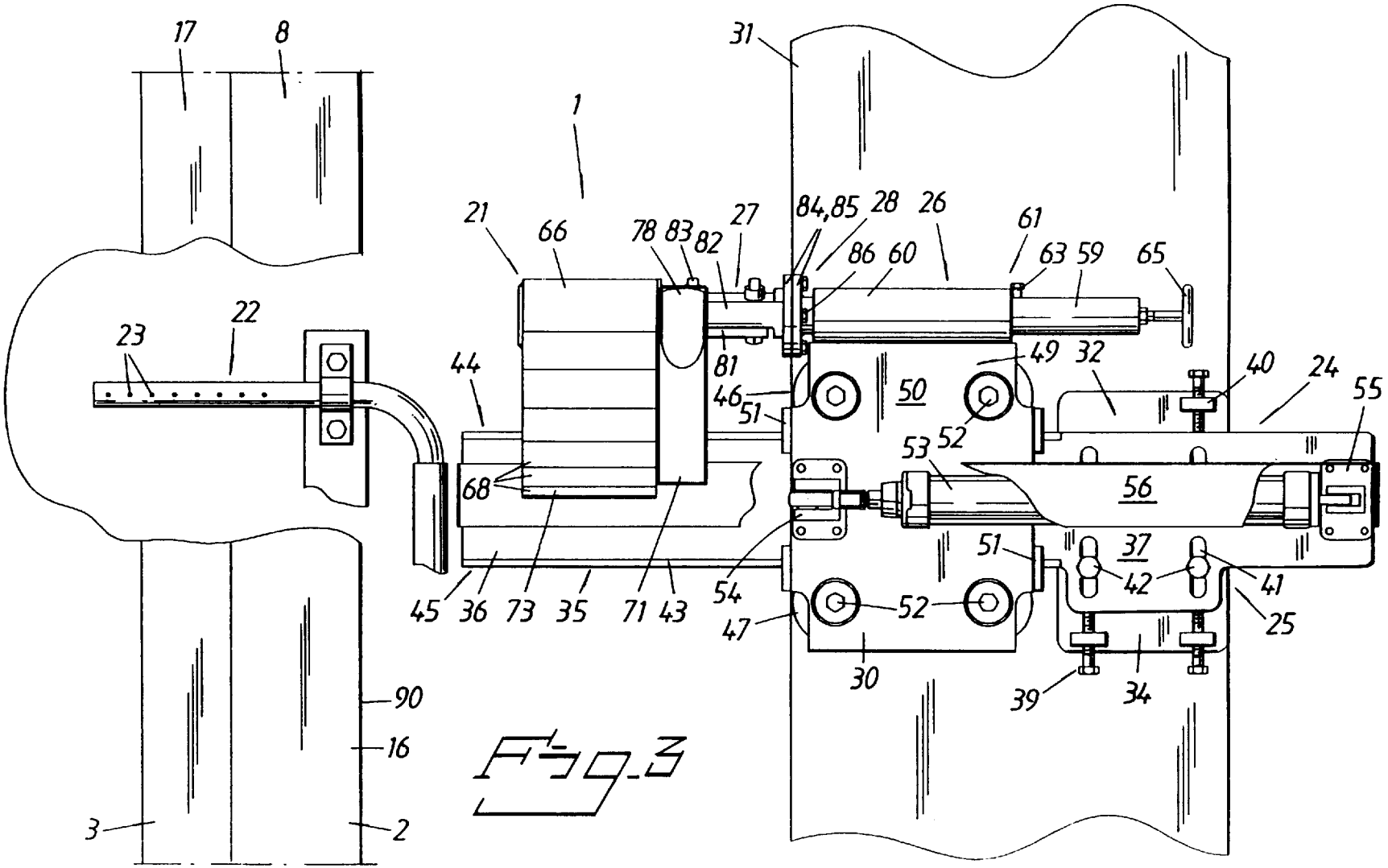
FIG. 3 is a schematic view from the front, seen upstream, of the threading device according to FIG. 2, with said transfer member in a retracted, inner felt-changing position and with a part of the felt cut away to show a blow tube.

The threading device 1, see FIG. 2 or 3, includes the transfer member 21 mentioned above which is arranged to be inserted at and above the led web 2 in a number of predetermined positions beside and between the web stabilizer 11 and the fiber web 2; a stand structure 24 at which a number of setting members 25, 26, 27, 28 are arranged for setting the position and direction of the transfer member 21 in relation to a drive section 29 receiving the leader 3, the drive section 29 comprising the inlet nip 9 to the drying section 7; a travelling member 30 movable linearly along the stand structure 24, to which travelling member the transfer member 21 is attached; and a suitable control and regulator unit 89 for operating of the threading device 1.

Figure 4:
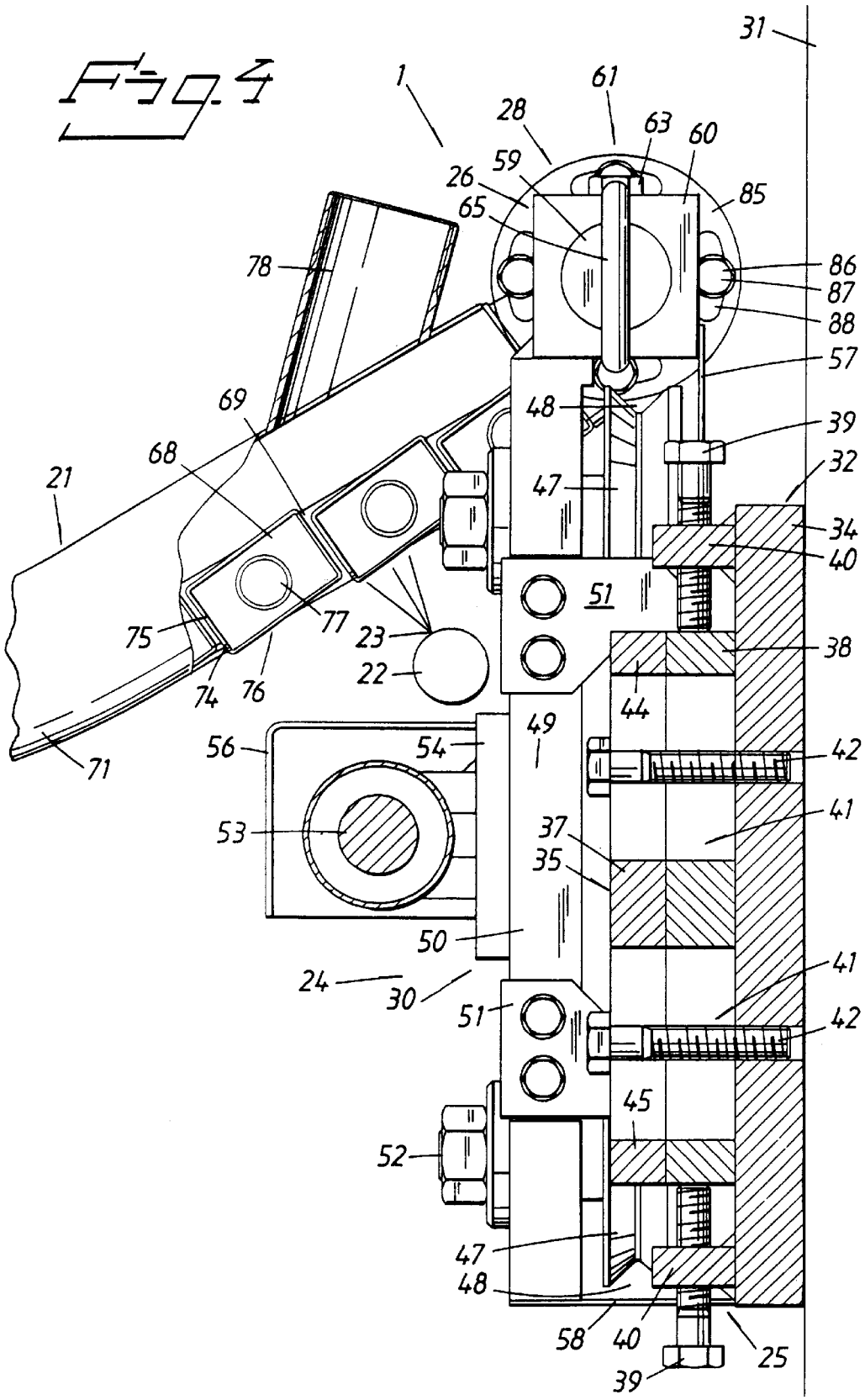
FIG. 4 is a schematic cross section through the threading device along the line IV—IV in FIG. 2, showing an attachment member for a machine stand, and first and second adjustment members for adjusting the vertical level-of the transfer member and its angle of entry in relation to the felt.

The threading device 1 is mounted on the machine stand 31 of the machine 4 by means of at least one attachment member 32, see FIG. 4, which consists in the embodiment shown of an attachment plate 34 welded to the operator side 33 of the machine stand 31. The attachment member 32 may, however, be secured to the machine stand 31 with the aid of any other suitable fixed or dismantlable joint with sufficient stability, e.g., a rivet or bolt joint, if this is deemed more advantageous.

The stand structure 24 comprises at least one support member 35, such as a beam, guide, rail or some other suitable profile with sufficient rigidity for the function. The support member 35 has an elongate positioning part 36 and at least one attachment part 37. In the embodiment illustrated in FIGS. 2–4 the attachment part 37 is in the form of a somewhat broader axial extension of the positioning part 36. The attachment part 37 is also joined to a first setting member 25 for adjustment of the height position of the stand structure 24 and thus the transfer member 21 above the fiber web 2. The member 25 for height adjustment comprises a sliding member 38, e.g., in the form of a welded metal plate, and a number of vertically acting adjustment devices 39 are arranged against the upper and lower side of this sliding member 38. In the embodiment illustrated in the figures, the adjustment devices 39 comprise adjustment screws arranged in attachment members 40 protruding from the attachment member 32. A number of vertical grooves 41 are also arranged extending coaxially through both the attachment part 37 and the height-setting member 25, in which grooves 41 a number of tightenable attachment members 42, e.g., bolts, are screwed to the attachment member 32. Height adjustment is achieved by loosening the attachment members 42, after which the adjustment devices 39 are caused to displace the sliding member 38 and thus the stand structure 24 upwards or downwards in a substantially vertical direction in relation to the machine stand 31 to a new desired position, after which the attachment members 42 are again tightened to fix the set position. In an embodiment not shown the sliding member may also comprise an additional spacing part-member, arranged between the attachment part and the sliding member, the part-member covering only a part of the outwardly facing surface of the sliding member so that sufficient edge space is left for the vertical grooves. A larger distance is thus created between the machine stand and the stand structure, thus facilitating accessibility to the inner side of the stand structure facing the machine stand. The vertical grooves and the attachment members fitted therein may in this case suitably be arranged extending only through the sliding member (in the remaining edge space mentioned above, close to the part-member), when the above-mentioned distance enables the use of turning tools between the threading device and the machine stand.

The positioning part 36, suitably in the form of a bracket, comprises guide members 43 in the form of one or more guide rails, guide grooves or guide surfaces, for the travelling member 30, e.g., in the form of a trolley or carriage arranged to run with a substantially to and fro horizontal, linear movement along the positioning part 36 in cooperation with the guide members 43. A suitable number of guide members 43 are arranged along the support member 35 at positions about its periphery determined by the cross-sectional shape of the positioning part 36 used. In the embodiment illustrated, see FIGS. 2–5, the elongate support member 35 consists of a solid steel plate 35 having rectangular, upright cross-sectional profile. The upper and lower edges 44, 45 of the steel plate 35 are bevelled along most of the length of the steel plate 35, thus forming the positioning part 36, whereas the bevelled edges 44, 45 constitute the guide members 43 for linear bearing 46 of the travelling member 30.

Figure 5:
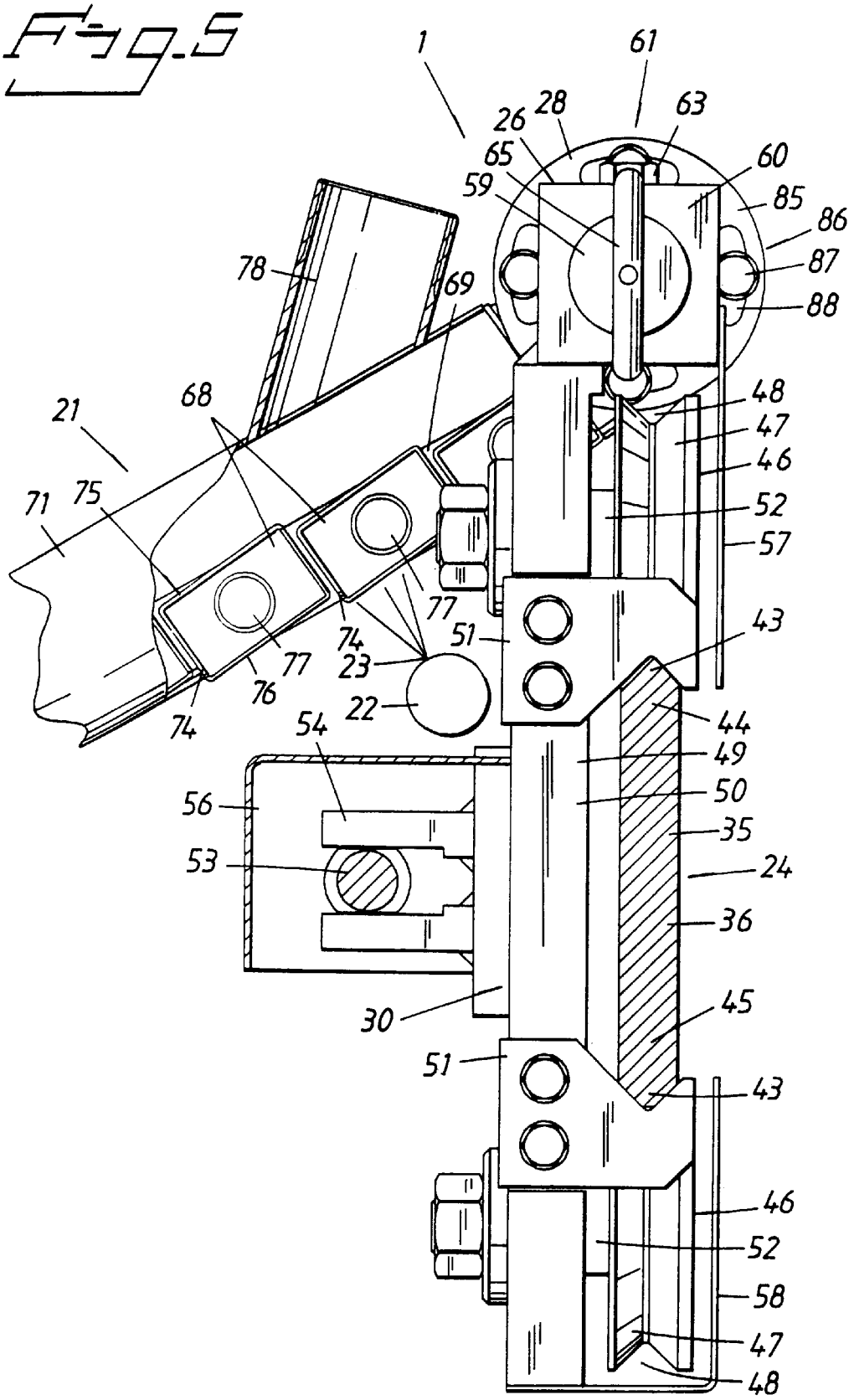
FIG. 5 is a schematic cross section through the threading device along the line V—V in FIG. 2, showing an elongate support member, along which a travelling member can be moved substantially horizontally.

The linear bearing 46 of the travelling member 30 is designed to minimize friction while at the same time ensuring that its movement along the guide members 43 is as linear as possible. This is achieved, for example, as shown in FIGS. 2 and 5 by the linear bearing 46 comprising a number of wheels 47 arranged on the upper and lower sides of the support member 35, for instance, the wheels being shaped to fit the profile of the guide member 43. In the case of the steel plate 35 shown in FIG. 5, a pair of wheels 47 are arranged at each of the bevelled edges 44, 45 of the steel plate 35, the wheels 47 being shaped with a peripheral groove 48 corresponding to the profile of the edges 44, 45. The travelling member 30 itself comprises a frame 49 arranged beside, or completely or partially surrounding the support member 35. In the case of the travelling member 30 shown in FIG. 5 the frame 49 comprises a substantially vertical rectangular attachment plate 50 arranged parallel to the outside of the support member 35. Scrapers 51 are attached at both the front and the rear end of the attachment plate 50 for automatic cleaning of the guide members 43 as the travelling member 30 moves along. The wheels 47 are rotatable on individual wheel axles 52 extending perpendicularly out through the attachment plate 50 at least the upper and lower edges of the travelling member 30. In other embodiments of the travelling member, not shown, additional wheels may be arranged, e.g., comprising substantially vertical wheel axles, at several sides or surfaces of the support member. Similarly, the frame of the travelling member may also comprise several substantially parallel attachment plates arranged on opposite sides of the support member with the wheel axles, and possibly additional bracings, extending between these attachment plates.

To enable movement of the travelling member 30 along the support member 35, and thus the substantially horizontal lateral adjustment of the position of the transfer member 21 in relation to the fiber web 2 at least one actuator 53, suitably automatically controlled, is arranged between two actuator attachments 54, 55. These comprise a first forward actuator attachment 54 arranged at the travelling member 30, and a second rear actuator attachment 55 arranged at the end of the support member 35 facing away from the fiber web 2. The actuator 53 consists suitably of a hydraulic or pneumatic piston cylinder, but may consist of an electric motor, for instance. A cover plate 56 also extends from end to end along the support member 35 to protect the actuator 53 and its attachments 54, 55 from undesired external influence such as dust and jolts. The linear bearing 46 of the travelling member 30 should also be screened from undesired external influence. In the embodiment shown in FIG. 5 this is achieved by additional cover plates 57, 58 arranged at the travelling member 30 so that all linear bearings 46 are protected.

A lateral setting member 26 is also arranged at the travelling member 30 for adjustment of a desired distance between the transfer member 21 and the travelling member 30 in its direction of travel. In the embodiment shown the lateral setting member 26 comprises a substantially horizontally displaceable carrier 59, e.g., in the form of an elongate shaft, arranged with one end at the transfer member 21 and its opposite end inserted in guide member 60, in this case tubular, at the upper edge of the travelling member 30. The guide member 60 comprises a locking device 61 with a restraining position 62 for each of the above-mentioned distances. The locking device 61 may consist, as shown in FIG. 2, of a cotter or screw 63 inserted through a hole 64 in the guide member 60, down into one of the restraining positions 62 mentioned above, suitably consisting of a number of holes drilled in the shaft 59. A gripping member 65 for the axial displacement of the carrier 59 is also arranged at its rear end, and thus arranged to be displaced further in its longitudinal direction with the aid of either the gripping member 65, suitably in the form of a handle, for manual adjustment, or automatically (not shown) with the aid of another actuator besides the one belonging to the travelling member, so that the felt loop 16 can be changed without the transfer member 21 getting in the way.

Figure 6:
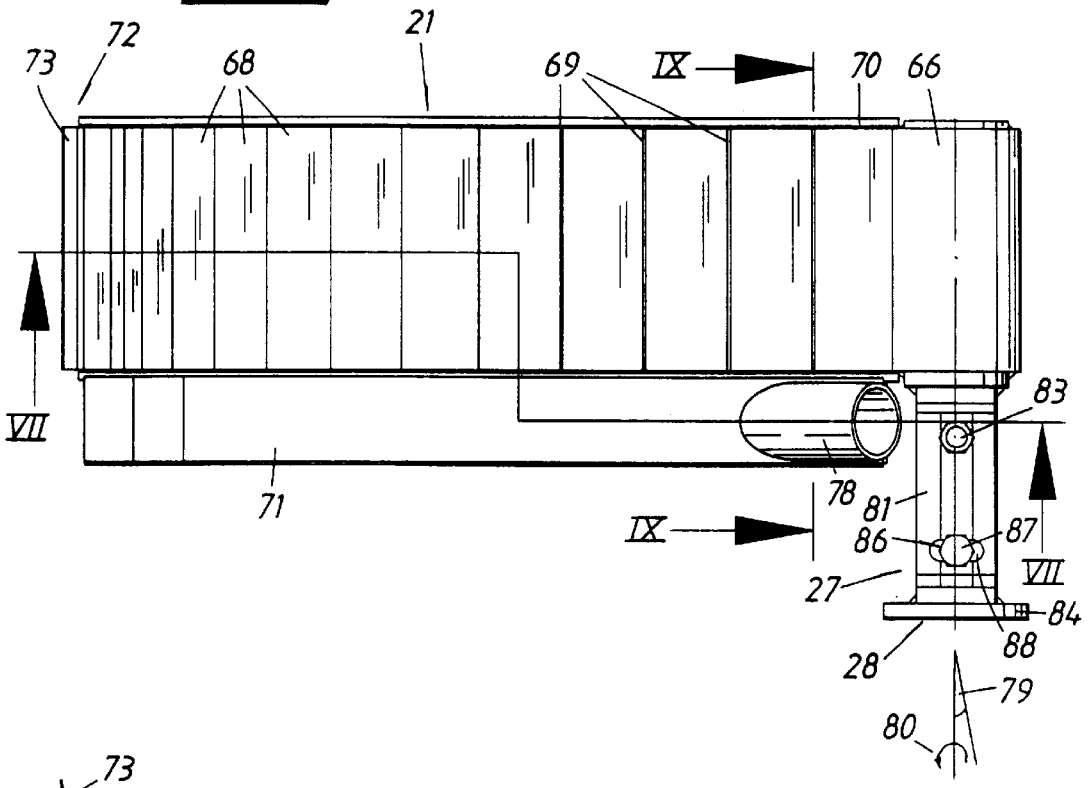
FIG. 6 is a schematic view from above of the transfer member of the threading device according to FIG. 1, showing a third adjustment member for adjusting the angle of feed of the transfer member in relation to the machine direction.
Figure 7:
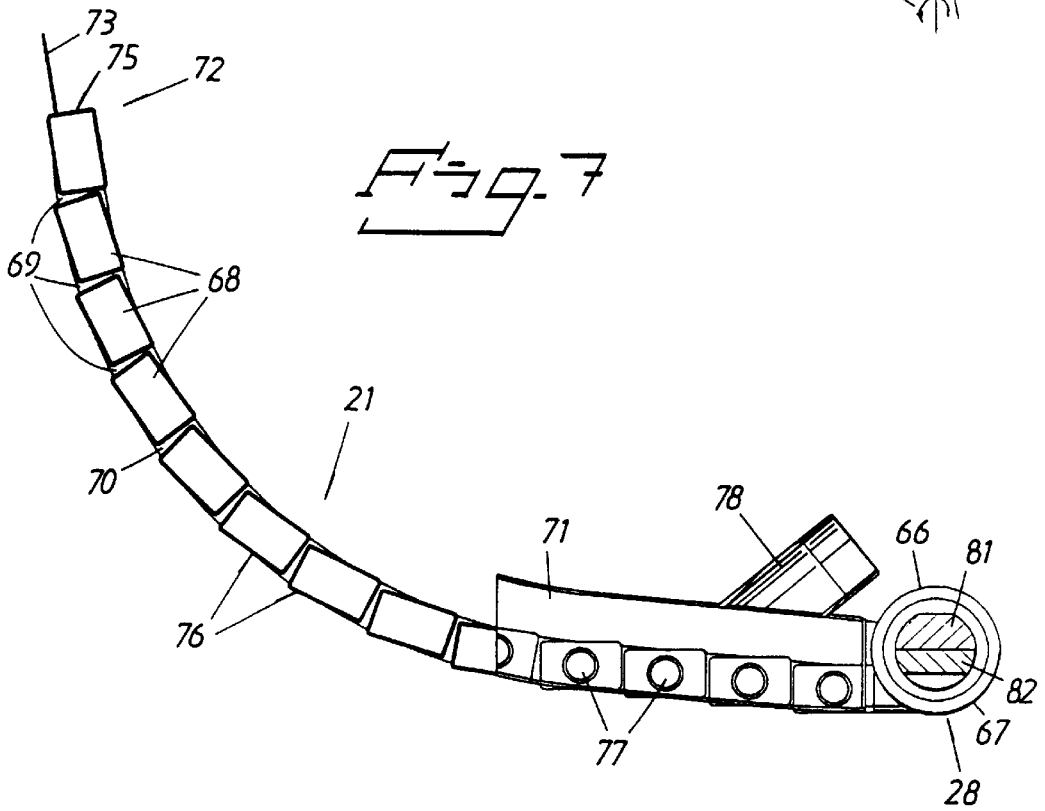
FIG. 7 is a schematic longitudinal section through the transfer member according to FIG. 6, including a number of air supply tubes and an air-distributing pipe.

At its upstream end the transfer member 21 connects with a guide means 66 arranged axially to the carrier 59, see FIGS. 6 and 7. The guide member 66 has an upstream side forming a sliding surface 67 with such a radius of curvature that the arriving leader 3 is always forced along the sliding surface 67 down towards the lower side of the transfer member 21. This will occur even if, due to web flutter for instance, the leader 3 is transferred to the transfer member 21 in a position somewhat above its optimum position.

Figure 8:
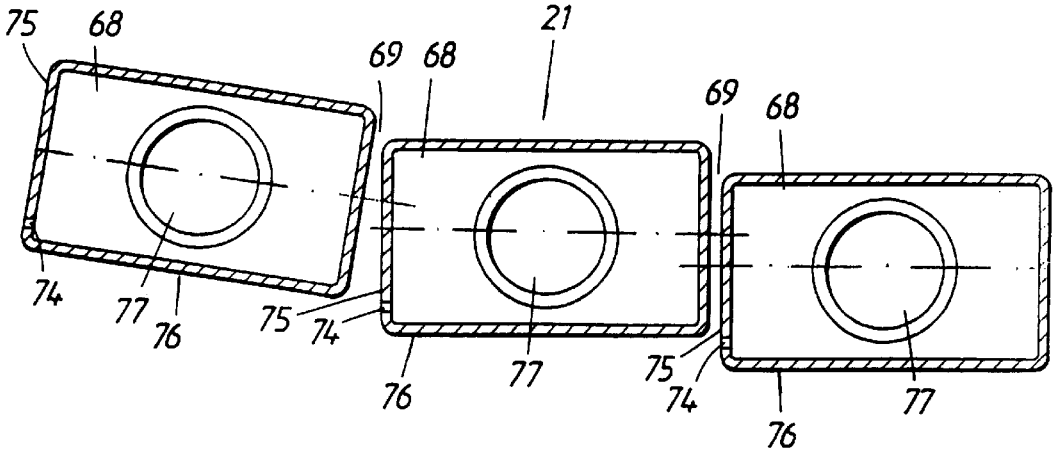
FIG. 8 is a schematic cross section through three of the air supply tubes of the transfer member according to FIG. 7, showing a number of exhaust openings in the lower edge of the front side of each air supply tube, facing the inlet nip of the drying section, and an inlet opening to each air supply tube from the air-distributing pipe.
Figure 9:
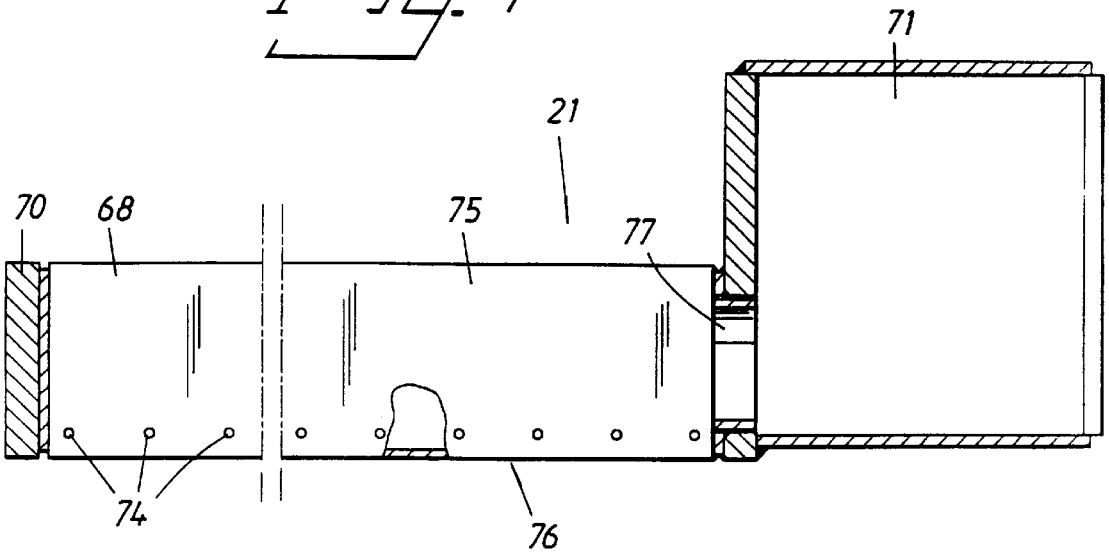
FIG. 9 is a schematic cross section, seen upstream, of parts of the transfer member along the line IX—IX in FIG. 6, showing the exhaust holes in one of the air supply tubes and its connection to the air-distributing pipe.

The transfer member 21 comprises several elongate air supply tubes 68 arranged substantially parallel and close together with a small space 69 between them. In the embodiment shown in FIGS. 7 and 8 the air supply tubes 68 have rectangular cross section. Each air supply tube 68 is welded at one end to an elongate connecting element 70 and at the other end to a similar elongate air distributing pipe 71 for compressed air. The air distributing pipe 71 and the elongate connecting element 70 extend with a certain curvature and substantially in the machine direction 17, from the guide member 66 along all the air supply tubes 68 towards the free outer end 72 of the transfer member 21. A guide plate 73 protrudes from this outer end 72, the function of which will be described below.

The transfer member 21 is provided with a large number of openings 74, e.g., holes or nozzles, to supply the compressed air in substantially the direction of movement of the fiber web 2. The holes 74 are therefore suitably arranged in the side 75 of each air supply tube 68 facing downstream, and are so shaped and directed and have such pitch that an even air flow is produced without disturbing turbulence, substantially along the lower side 76, i.e., the sliding surface, of the following air supply tube 68. In order to achieve this the air supply tubes 68 are displaced in relation to each other so that, together, they form a stair-like configuration with a certain length and shape determined by the function of the transfer member 21 and the goal of the leader 3. From an initial straight configuration of the air supply tubes 68, see FIGS. 7 and 8, in which the sliding surface 76 of each air supply tube 68 facing the leader 3 is initially arranged completely parallel to the direction of travel of the outlet device 8, the configuration continues in a gentle, slowly increasing curve out towards the free outer end 72 of the transfer member 21. This increasing curvature is achieved by the sliding surfaces 76 of the air supply tubes 68 being axially turned slightly in relation to each other, the turn gradually increasing towards the free end 72 of the transfer member 21, i.e., the sliding surfaces 76 gradually assume a position turned slightly upwards in relation to the sliding surface 76 of the previous air supply tube 68. The transfer member 21 thus acquires a substantially coherent sliding surface 76 for the leader 3, the curve of this sliding surface 76 increasing in the downstream direction for each air supply tube 68, with the desired direction of the leader towards its goal in the active threading position, e.g., the inlet nip 9 of the drying section 7 (see FIG. 1).

The air distributing pipe 71, see FIG. 7, is provided with outlet openings 77 to each of the air supply tubes 68 so that the supply of compressed air, controllable through a throttle valve (not shown) at a common compressed air connection 78, is thus ensured for all air supply tubes 68. Thus a large number of hoses, i.e., one for each air supply tube 68, forming a coil of hoses, can be avoided. Since each outlet opening 77 has a certain predetermined diameter, the air distributing pipe 71 distributes the compressed air necessary for leading the leader 3, with a suitable distribution for each air supply tube 68 so that automatic threading is obtained.

In another embodiment of the air distributing pipe, not shown, a separate throttle valve is arranged for each air supply tube so that an optimum air flow can be set for each individual air supply tube in relation to its position in the transfer means. The flow of compressed air can thus be adjusted to the basis weight of the fiber web in question so that fiber webs having lower basis weight are prevented from being blown to pieces or starting to flutter.

The two additional setting members 27,28 mentioned above for adjusting the angle of feed 79 and entry angle 80 of the supply member 21 and thus also of the leader 3, see FIG. 6, in relation to the receiving drive section 29 are arranged between the carrier 59 and the guide member 66. In the application of the threading device 1 shown in FIG. 1, the angle of feed 79 refers mainly to the angle formed between the direction of travel of the fiber web 2 on the outlet device 8 and the longitudinal direction of the transfer member 21 in relation to this direction of travel. The entry angle 80 refers mainly to the angle the direction of travel of the leader 3 forms to the normal plane to the inlet nip 9 of the receiving drive section 29.

The angle of feed 79 is adjusted by turning the transfer member 21 in the plane of the fiber web 2 at an angle to the longitudinal axis of the carrier 59, whereas the entry angle 80 is adjusted by turning the transfer member 21 about the longitudinal axis of the carrier 59. The setting member 27 for adjusting the setting of the angle of feed 79, as shown in FIG. 6, is composed of an axial element 81, 82 divided lengthways into at least two pieces and arranged in the longitudinal direction of the carrier 59, which part elements 81, 82 can be displaced about a joint 83 arranged perpendicular to the longitudinal axis of the carrier 59. The transfer member 21 is connected to one end of the elements 81, 82 and the setting member 28 is connected to their other end in order to adjust setting of the entry angle 80. This setting member 28 is also composed of the two elements 84, 85 arranged opposite each other and perpendicular to the longitudinal direction of the carrier 59. Both these setting members 27, 28 comprise cooperating friction surfaces between the elements 81, 82, 84, 85 which surfaces, by application of a requisite external force, are given sufficient friction to maintain the position set. A number of adjustment members 86, suitably screws, extend through the elements 81, 82, 84, 85 for application of this external force. Each adjustment member 86 has a blocking member 87 protruding from one or the other of the elements 82, 84, see FIGS. 2, 3, 5 and 6, the blocking member 87 being inserted in a groove 88 arranged in the other element 81, 85 upon adjustment. The end of these grooves 88 form end positions for maximum adjustment of the angle setting members 27, 28.

Briefly, the function of the threading device 1 is as follows: When threading of the fiber web 2 is to be performed, after a web rupture, for instance, the whole web 2, arriving continuously and still uncut, is allowed to fall down into the reject disintegrator until the moment when the front end of the cut leader 3 arrives at the relevant open draw 5 and the threading device 1 arranged there. This is because the machine 4 is only stopped in emergencies. Initially the web remnant 20 then constitutes most of the web width and this is therefore also normally recovered by allowing it to continue to accompany the lower felt 16 down into the disintegrator.

The transfer member 21 which has initially been retracted in a passive waiting position outside the web edge 90 of the felt 16 facing the operator side 33, ready for immediate activation when the next web rupture occurs, is now pushed by the actuator 53 to a threading position, see FIG. 2, immediately prior to arrival of the leader 3.

At that moment the blow pipe 22 which is arranged inside the felt loop 16 of the outlet device 8 emits a compressed air jet through the felt loop 16 towards the lower side of the leader 3 in order to force this towards the transfer member 21, the lower side 76 of which is thus arranged just above the upper surface of the fiber web 2.

Upon activation of the threading device 1 the transfer member 21 is thus moved to its operating position, i.e., the threading position, above and immediately adjacent the felt 16 and the leader 3 carried thereon with the aid of the actuator 53. The air supply tubes 68 of the transfer member 21 emit an even flow of air from the nozzles 74 facing downstream, which air flow, together with the air flowing down through the space 69 between each air supply tube 68, creates a negative pressure, an ejector action, which draws the leader 3 with it along the lower side 76 of the transfer member 21. The blowing thus results in a Coriolis effect entailing both a suction action and an ejector action so that the leader 3 is sucked firmly towards but at the same time along the lower side 76 of the transfer member 21. The sliding surfaces 67 of the air supply tubes 68 initially form a substantially straight surface 76, apart from the slight difference in level between the holes 74 arranged one after the other, which surface 76 continues after a suitable number of air supply tubes 68 into a line with increasing curvature. This curvature gives the web 2 a predetermined direction of feed towards an intended goal, e.g., the inlet nip 9 to the drying section 7. Thanks to the guide plate 73, even the outermost air supply tube 68 arranged in the transfer member 21 acquires a surface along which the air jets from the outermost air supply tube 68 can pass, thus creating a propelling negative pressure here also.

When the transfer member 21 has been moved in over the leader 3 of the fiber web 2 the compressed air is switched on, after about 3–5 seconds, so that it flows out through the openings 74 in the lower edge of each air supply tube 68. The air flow from the openings 74, together with air flowing down between the air supply tubes 68 creates the negative pressure described above and the ejector action that draws the leader 3 firmly to the lower side of the transfer member 21 and also blows it on to the next drive section 29 in the paper or board machine 4. The compressed air may be switched off again and the threading device 1 is withdrawn again after a few seconds into its passive waiting position, ready to come into operation in the event of another web rupture, and once again assume its threading position.

The transfer member 21 moves between substantially three positions, a first, outer operating or threading position, a second, inner waiting position, and a third felt-changing position which is further retracted.

1. Operating or threading position, see FIG. 1: The transfer member 21 is arranged above and adjacent the felt 16 in an area of about 100 mm, the leader area, where the leader 3 will arrive as predetermined, the leader area being situated inside and adjacent to the edge 90 of the felt 16.

2. Waiting position: The travelling member 30 is in a rear position by the support member 35 where it has been retracted by the actuator 53, with the transfer means 21 outside the edge 90 of the felt 16.

3. Felt-changing position, see FIG. 3: The transfer member 21 is fully retracted inside the end of the support member facing the web edge 90, and with the transfer member 21 folded down so far that there is no risk of the free outer end 72 of the guide plate 73 damaging the felt 16 while it is being fitted during the felt change.

It will be understood that both the number, the size and the shape of the elements included in the threading device 1, such as its stand structure 24, are adapted to the position in the paper or board machine 4 where the threading device 1 is to be mounted and that the stand structure 24, for instance, may in principle have any cross-sectional form, that the actuators 53 may be one or more in number, and so on.

The compressed air from the openings 74 in the transfer member 21 has greater velocity than the moving web 2 and a tensile stress therefore appears in the leader 3, thus enabling more stable transfer without flutter. The machine speed is also somewhat faster in the drying section 7 and the tensile stress is thus further reinforced when the leader 3 has been gripped by the drying wire loop 14 of the web stabilizer 11.

In another embodiment, not shown, the threading device 1 is located in another place inside the press section at an open draw formed between two consecutive, unconnected press nips.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A device for drawing a fibrous web between upstream and downstream web-carrying elements in a machine for making the fibrous web, said device comprising:

a stand structure positioned on a side of the machine and adjacent an edge of the fibrous web;

a transfer member having a width extending in the cross-machine direction, said transfer member being configured to retain the fibrous web and draw the web from the upstream web-carrying element toward the downstream web-carrying element; and a travelling member for supporting said transfer member thereon, said travelling member being slidably supported on said stand structure such that the transfer member is non-pivotal linearly movable between a first active position adjacent a surface of the web for drawing the web and a second passive position retracted from the active position and the surface of the web.

2. A device as defined in claim 1 further comprising a first setting device for moving the stand structure in a direction having a component perpendicular to the web surface such that the distance between the transfer member and the web surface can be adjusted.

3. A device as defined in claim 1 further comprising a second setting device mounted between the travelling member and the transfer member for setting the distance between the travelling member and the transfer member.

4. A device as defined in claim 3 wherein said second setting member comprises a displaceable carrier having one end for supporting the transfer member and an opposite end displaceably mounted to the travelling member.

5. A device as defined in claim 4 wherein travelling member further comprises a locking device for locking said displaceable carrier in any one of a number of predetermined positions.

6. A device as defined in claim 5 further comprising a gripping member for facilitating manual displacement of the carrier.

7. A device as defined in claim 5 further comprising an actuator for displacing the carrier.

8. A device as defined in claim 1 wherein said transfer member is movably mounted on said travelling member to be further movable to a third felt-changing position where said transfer member is even further retracted from the surface of the web than when in said second position.

9. A device as defined in claim 1 wherein the stand structure further comprises an attachment part for attaching the stand structure to a machine stand and an elongate positioning part having at least one guide member along which the travelling member is linearly movable.

10. A device as defined in claim 9 wherein the travelling member further comprises at least one scraper for cleaning the guide member as the travelling member moves linearly along the guide member.

11. A method of threading a fibrous web between upstream and downstream web-carrying elements in a machine for making a fibrous web, said method comprising the steps of:

cutting across the fibrous web to create a leader;

moving a transfer member in a non-pivotal linear direction from a retracted position to an active position adjacent the intended path of travel of the leader;

flowing air from the transfer member to create an airflow;

positioning the leader adjacent to the air flow to thereby create a negative pressure adjacent the surface of the web to retain the web;

drawing the leader of the web from the upstream web-carrying element toward the downstream web-carrying element; and retracting the transfer member in a non-pivotal linear direction from the active position to the retracted position.

12. A method as defined in claim 11 comprising the further step of adjusting the position of the transfer member in a direction having a component perpendicular to the web surface such that the distance between the transfer member and the web surface can be adjusted.

13. A method as defined in claim 11 wherein the transfer member is supported on a linearly movable travelling member and said method further comprises the step of adjusting the distance between the transfer member and the travelling member.

14. A method as defined in claim 13 comprising the further step of moving the travelling member even further from the web to a felt-changing position after said retracting step.

15. A method as defined in claim 13 comprising the further step of moving the travelling member along a guide member.

16. A device for drawing a fibrous web between upstream and downstream web-carrying elements in a machine for making the fibrous web, said device comprising:

a stand structure positioned on a side of the machine and adjacent all edge of the fibrous web;

a transfer member supported on said stand structure and defining a feed angle with respect to the machine direction of the moving fibrous web and an entry angle with respect the plane defined by the surface of the fibrous web, said transfer member being configured to retain tie fibrous web and draw the web from the upstream web-carrying element toward the downstream web-carrying element; and a pair of setting members wherein one of said setting members allows adjustment and setting of the feed angle and the other allows adjustment and setting of the entry angle of the transfer member relative to the fibrous web.

17. A device as defined in claim 16 wherein said transfer member is supported on a carrier defining an axis which carrier is in turn supported on the stand structure, said setting member including a joint which allows rotation of the transfer member about an axis perpendicular to the axis of the carrier.

18. A device as defined in claim 16 wherein said transfer member is supported on a carrier defining an axis which carrier is in turn supported on the stand structure, said setting member allowing rotation of the transfer member about the axis of the carrier.

* * * * *